US006650029B1

(12) United States Patent
Johnston

(10) Patent No.: US 6,650,029 B1
(45) Date of Patent: Nov. 18, 2003

(54) REMOTELY CONTROLLABLE ELECTRICAL SWITCHING APPARATUS

(75) Inventor: James William Hunter Johnston, Lydney (GB)

(73) Assignee: Exodus Electronic Limited, Cwmbran (GB)

( * ) Notice: Subject to any disclaimer, the term of this patent is extended or adjusted under 35 U.S.C. 154(b) by 291 days.

(21) Appl. No.: 09/676,221

(22) Filed: Sep. 29, 2000

(51) Int. Cl.[7] ..... H01H 47/00
(52) U.S. Cl. ..... 307/125; 307/114
(58) Field of Search ..... 307/125, 114, 307/112

(56) References Cited

U.S. PATENT DOCUMENTS

| | | | | | |
|---|---|---|---|---|---|
| 5,189,412 | A | * | 2/1993 | Mehta et al. | 340/825.22 |
| 5,237,264 | A | * | 8/1993 | Moseley et al. | 323/324 |
| 5,340,954 | A | | 8/1994 | Hoffman et al. | |
| 5,559,406 | A | | 9/1996 | Chang | |
| 5,650,774 | A | * | 7/1997 | Drori | 340/5.22 |
| 5,767,841 | A | * | 6/1998 | Hartman | 345/167 |
| D406,847 | S | * | 3/1999 | Gerba et al. | D14/218 |
| 5,895,985 | A | * | 4/1999 | Fischer | 307/116 |

FOREIGN PATENT DOCUMENTS

| | | | | |
|---|---|---|---|---|
| CA | 2141064 | | 12/1996 | |
| EP | 0 847 033 A2 | * | 6/1998 | G08C/17/00 |
| EP | 0 889 453 A2 | * | 6/1998 | G08C/19/28 |
| GB | 2 051 440 A | * | 1/1981 | G08B/9/00 |
| GB | 2099607 | | 12/1982 | |
| GB | 2 218 552 A | * | 11/1989 | G08B/19/00 |
| GB | 2271872 | | 4/1994 | |
| GB | 2294569 | | 1/1996 | |
| GB | 2312540 | | 10/1997 | |
| GB | 2320119 | | 10/1998 | |
| GB | 2230367 | | 12/1999 | |
| WO | 9201968 | | 2/1992 | |
| WO | 9719431 | | 5/1997 | |

OTHER PUBLICATIONS

British Patent Office Search Report issued on U.K. counterpart application No Date Provided.

* cited by examiner

*Primary Examiner*—Gregory J. Toatley, Jr.
(74) *Attorney, Agent, or Firm*—Edwin D. Schindler

(57) ABSTRACT

A control apparatus for a light includes a control unit and a plurality of remote control devices. The control unit changes the state of the light, either when a conventional wall switch is actuated or when a control signal is received from one of the remote control devices, which allows the light to be controlled from a further point without the need to run additional wires down a wall to an additional switch. Each remote control device can transmit a signal to put the control unit into an ERASE mode, upon which the address codes of all remote control devices are erased from its memory, with the exception of the address code of the control device which gave the command to enter the "erase" mode. In this manner, the control unit can be re-configured remotely to respond solely to the control device which gave-the command to the control unit.

6 Claims, 5 Drawing Sheets

REMOTELY CONTROLLABLE ELECTRICAL SWITCHING APPARATUS

BACKGROUND OF THE INVENTION

This invention relates to switching apparatus for controlling electrical loads, such as lights.

Lights in dwellings and other buildings are generally controlled by a wall-mounted switch, which is arranged in the lighting circuit to physically connect or disconnect wires that extend between the mains supply and the light. Typically such wires are installed during construction of the dwelling etc., so that they are hidden from view.

It is often desirable to be able to add further light switches, so that a light can be controlled by more than one switch. It is also sometimes desirable to move light switches to another location.

Hitherto, in order to add or move a light switch, additional wires have had to be routed through the ceiling cavity and then down the wall to the location of the new switch. The wires extending down the wall can be concealed by routing them through a channel formed in the wall. However, a disadvantage of this is that it is difficult, time consuming and messy to channel out the wall and then reinstate the wall afterwards. Furthermore, it is not always practical to channel out the wall, for example in situations where wallpaper has been applied to the wall.

It has been proposed to overcome this problem by routing the wires through a plastic conduit attached to the wall. However, such plastics conduits are almost as unsightly as having bare wires extending down the wall.

Another disadvantage of adding switches is that the existing switch needs to be wired in a special manner, otherwise the switches will work independently of each other, thereby creating the problem that the light cannot be turned off, except from the switch that was used to turn it on.

We have now devised an electrical switching apparatus which alleviates the above-mentioned problems.

SUMMARY OF THE INVENTION

In accordance with this invention as seen from a first aspect, there is provided an electrical switching apparatus comprising a remote control device which can be actuated to transmit a wireless control signal and a control unit having a receiver for receiving said signal, a switching device for connecting in series between a load to be switched and a current supply, a switch terminal for connecting to a conductor extending from a remote switch, and control means for changing the switching state of said switching device, either when a change is detected in a signal on said switch terminal or when said wireless control signal is received by said receiver.

The apparatus can be configured to provide an additional switch point for an existing switched light by disconnecting the light from the remote existing switch and connecting the control unit, such that the switching device of the unit is arranged in series between the light and the mains supply. The wire from the existing remote switch can then be connected to the switch terminal of the control unit.

In a first state of the switching device, no supply current flows and hence the light is off. However, the state of the switching device can be changed either by actuating the remote control device to transmit said wireless control signal or by actuating the existing remote switch. Accordingly, the light is turned on when either the remote control device or the existing switch are actuated.

Correspondingly, the state of the switching device can be changed back to its original state either by actuating the remote control device or the existing switch.

Thus, it will be appreciated that the remote control device provides a further point at which the light can be turned on or off, either in addition to or instead of the existing switch.

The apparatus enables the light to be turned off either by the existing switch or the remote control device, regardless of which device was used to turn the light on.

The remote control device sends wireless control signals to control the light and thus the need to run additional wires down the wall to an additional switch is avoided.

In one embodiment, the remote control device can be a hand-held device.

In an alternative embodiment, the remote control device comprises means for mounting it to a wall or other structure, the device preferably resembling a conventional wall switch.

In one embodiment, the remote control device is arranged to transmit wireless on and off control signals upon actuation of respective switches, the control device of the control unit being arranged to change the state of said switching device in accordance with the received wireless control signal.

In an alternative embodiment, the remote control device is arranged to transmit a wireless control signal for a predetermined time period after actuation of a switch, the control device of the control unit being arranged to change the state of said switching device when said wireless control signal is received.

The most convenient place to situate the control unit is adjacent the connection point of the light, since at this point there are usually wires carrying a constant and a switched mains supply.

The control unit may be installed in a void above the ceiling. Alternatively, the control unit may comprise a housing for attaching to the ceiling in place of a conventional ceiling lighting rose.

Preferably the switching device can be controlled to vary the amount of power delivered to the load, so that loads such as lights can be dimmed.

The remote control devices are preferably each arranged to transmit unique wireless control signals, the control unit being programmable to respond to selected control devices only.

The control unit can be configured to respond to selected control devices only by selecting a LEARN mode of the unit, using a switch on the unit. In the LEARN mode, the control unit is arranged to store the identity of any remote control device that transmits a wireless control signal to it.

In an OPERATE mode of the control unit, the control unit will only respond to control signals received from remote control devices whose identities are stored in its memory.

A disadvantage of this arrangement is that the control unit is often installed in a ceiling void, once it has been programmed with the identity of the control devices which it is to respond to. Thus, following installation, it not possible to gain access to the mode selection switch on the control unit, to change the identities of the control devices which it is to respond to.

It has been proposed to overcome this problem by providing a remote mode selection switch on each remote control devices. In use, the remote mode selection switch on one of the remote control devices can be actuated to set the control unit in the LEARN mode. However, a disadvantage of this is that it difficult to determine the identities of control devices that are to be removed from the memory of the control unit. Thus, the control unit may continue to respond to control devices that are no longer required or which have been assigned to other control units.

Accordingly, in accordance with this invention as seen from a second aspect, there is provided an electrical switching apparatus comprising a control unit configured to respond to a plurality of remote control devices, wherein at least one of the remote control devices can remotely re-configure the control device to respond solely to it.

In use, if the control unit is to be re-configured to respond to different or additional remote control devices, one of the remote control devices can be used to initially re-configure the control unit to respond solely to it, so that the user then knows the exact configuration of the control unit. Following this, the control unit can be set in the LEARN mode, whereupon the control unit can be configured to respond to additional remote control devices.

It is sometimes desirable to be able to fit a light switch in a glass partition. However, a disadvantage of this is that the reverse side of the switch will look unsightly. Furthermore, the wires extending from the switch will also look unsightly.

It is also sometimes desirable to be able to control lights from either of two regions separated by a wall or partition.

Accordingly, in accordance with this invention as seen from a third aspect, there is provided a switch assembly comprising a switching means connected to a transmitting device, said transmitting device being arranged to transmit wireless remote control signals upon actuation of said switching means, the switching means being actuable from either opposite side of the assembly.

In use, the assembly can be installed in an aperture through a wall or partition, with its opposite sides facing outwardly from respective opposite sides of the wall or partition. The assembly can thus be installed in glass partitions etc. since both sides of the assembly are intended to be visible.

The assembly transmits remote control signals to operate lights etc. and thus no unsightly wires are required.

The assembly also enables a light or other loads to be controlled from locations on either side of a wall or partition.

In one embodiment, the switching means comprises a pair of switching members electrically connected in parallel to said transmitting device, the switching members each having actuators respectively arranged on opposite sides of the assembly.

In an alternative embodiment, the assembly comprises a single switching member having a pair of actuators respectively arranged on opposite sides of the assembly.

Preferably the assembly comprises a pair of flat faceplates for respectively mounting on opposite sides of the assembly.

BRIEF DESCRIPTION OF THE DRAWINGS

An embodiment of this invention will now be described by way of an example only and with reference to the accompanying drawings, in which.

DETAILED DESCRIPTION OF THE PREFERRED EMBODIMENT

Figure 1:
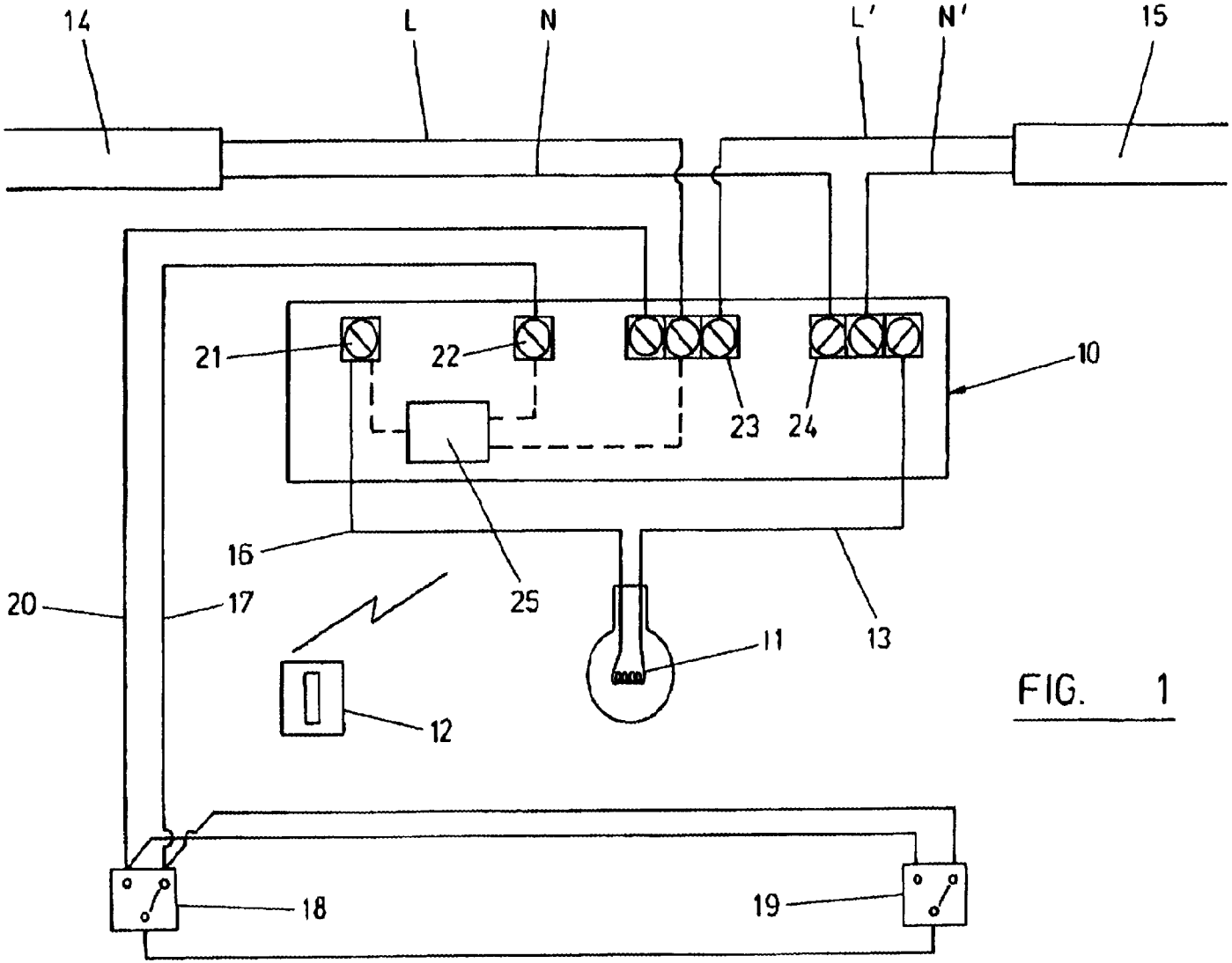
FIG. 1 is a schematic diagram of an electrical switching apparatus in accordance with this invention, for controlling a light.

Referring to FIG. 1 of the drawings, there is shown an electrical switching apparatus comprising a control unit 10 for mounting above the ceiling, adjacent an existing lighting fixture for an electrical light 11 and a remote control device 12.

Prior to installing the apparatus, the light 11 used to be connected, such that one of its wires 13 was connected to the neutral wires N, N' of a mains supply cables 14, 15 of the lighting circuit.

The other wire 16 of the light 11 was connected directly to a switched output wire from a single wall switch or to switched output wire 17 from a plurality of interconnected wall switches 18, 19, which are configured as shown in FIG. 1, so that they can each turn the light on or off, regardless of the state of any of the other switches. The live mains wires L, L' of the supply cables 14, 15 were connected to a wire 20, which feeds live mains to the wall switch or switches.

Thus, it will be appreciated that the light 11 would be energised, whenever the switched wire 17 from the wall switch or switches became live.

In accordance with this invention, the switching apparatus can be fitted in order to provide one or more extra switch points to supplement or replace any of the existing wall switches that control the light 11.

The control unit 10 of the present invention comprises a switched terminal 21 and a sensing 22 terminal, as well as conventional live and neutral terminal blocks 23, 24. The circuit connected substantially as the existing circuit, with the exception that the live wire 16 to the light 11 is connected to the switched terminal 21 of the control unit 10, instead of to the switched wire 17 from the wall switch or switches.

The switched wire 17 is connected to the sensing terminal 22 of the control unit 10. The control unit 10 comprises a control circuit 25 incorporating a triac switching device (not shown), which is arranged to apply live mains from the live terminal block 23 to the switched output terminal 21. The gate of the triac is connected to a sensing circuit (not shown) of the control circuit 25. The control circuit 25 further comprises a radio receiver (not shown), which is arranged to receive radio remote control signals directly from the remote control device 12 or from a repeater device, which extends the range of the remote control device 12.

The remote control device 12 comprises ON and OFF actuators, which cause the transmitter to respectively transmit control signals for turning the light 11 on and off.

Figure 2:
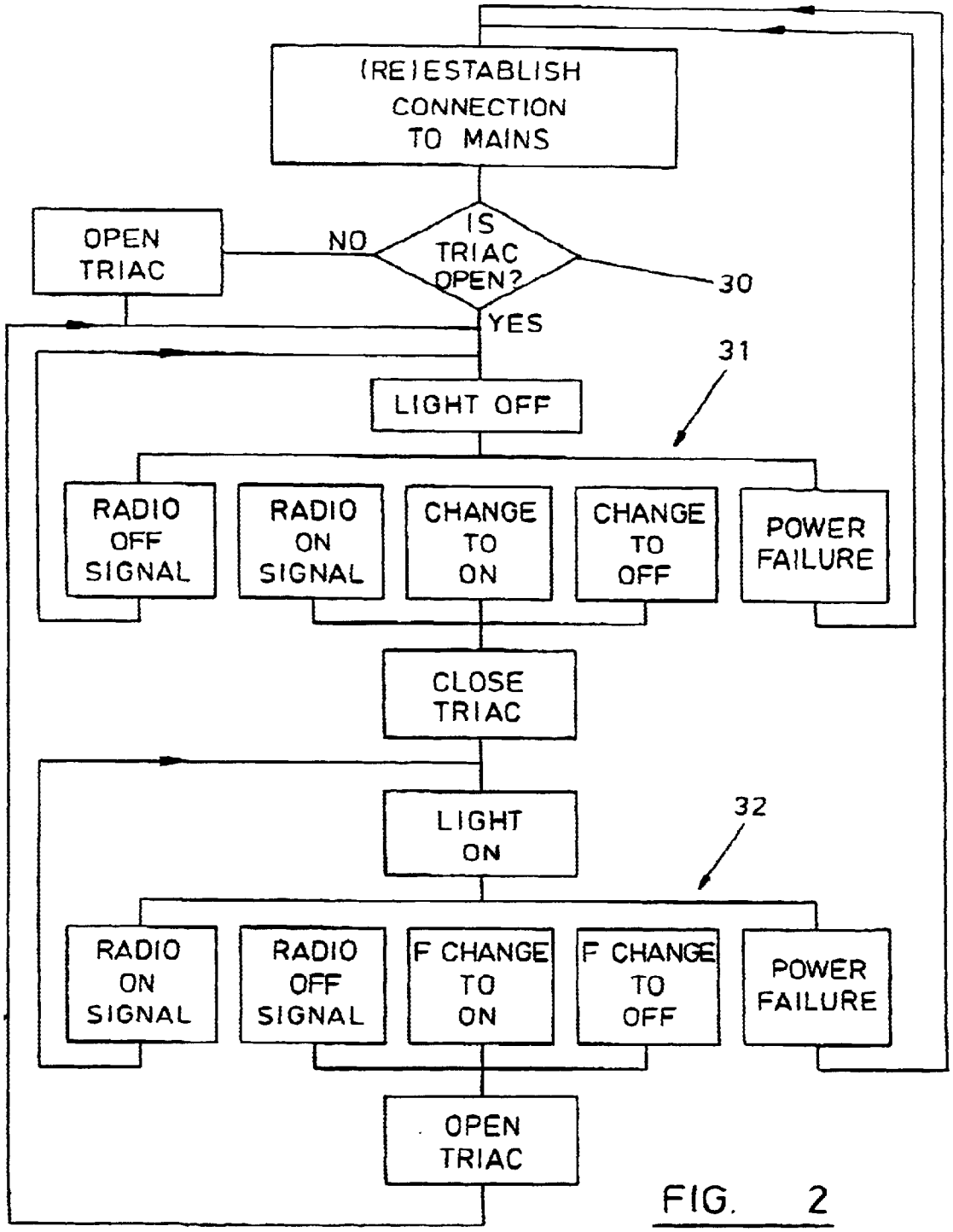
FIG. 2 is a flow diagram to explain the switching operation of the apparatus of FIG. 1.

Referring to FIG. 2 of the drawings, when power is first applied to the control device a test is performed at step 30, in order to see whether the triac is configured to apply power to the light 11. If power is applied to the light 11, the triac is controlled to remove power from terminal 21, so that the light 11 is always off when power is initially applied to the device 10.

When the light 11 is off, at step 31, the sensing circuit of the control circuit 25 continuously monitors whether the receiver has received a remote control ON signal or whether the signal on sensing terminal 22 has changed from 'mains' to 'no mains' or vice-versa. If either of these conditions are detected, the triac is controlled to apply power to the light 11, so that the light 11 is turned on. However, if a remote control OFF signal is received at step 31, then the light remains off.

When the light 11 is on, at step 32, the sensing circuit of the control circuit 25 continuously monitors whether the receiver has received a remote control OFF signal or whether the signal on sensing terminal 22 has changed from 'mains' to 'no mains' or vice-versa. If either of these conditions are detected, the triac is controlled to turn the light 11 off, otherwise the light remains on.

It will be appreciated that the signal on the switched wire 17 from the switches 18,19 changes from 'mains' to 'no mains', or vice-versa whenever either switch is actuated. Thus, the light will be turned from on to off or vice-versa whenever either switch is activated or when an appropriate remote control signal is received from the remote control device 12.

In an alternative embodiment, the control unit can be configured to turn the light on and off whenever appropriate short duration control signals are received. However, if a long duration control signal is received, this has the effect of slowly dimming the light 11 from on to off or vice-versa.

The remote control device 12 may be a hand-held device or a wall-mounted device.

In the latter case, it will be appreciated that the apparatus has the effect of providing an extra wall switch without the requirement to route wires down the wall from the light 11.

Figure 3A:
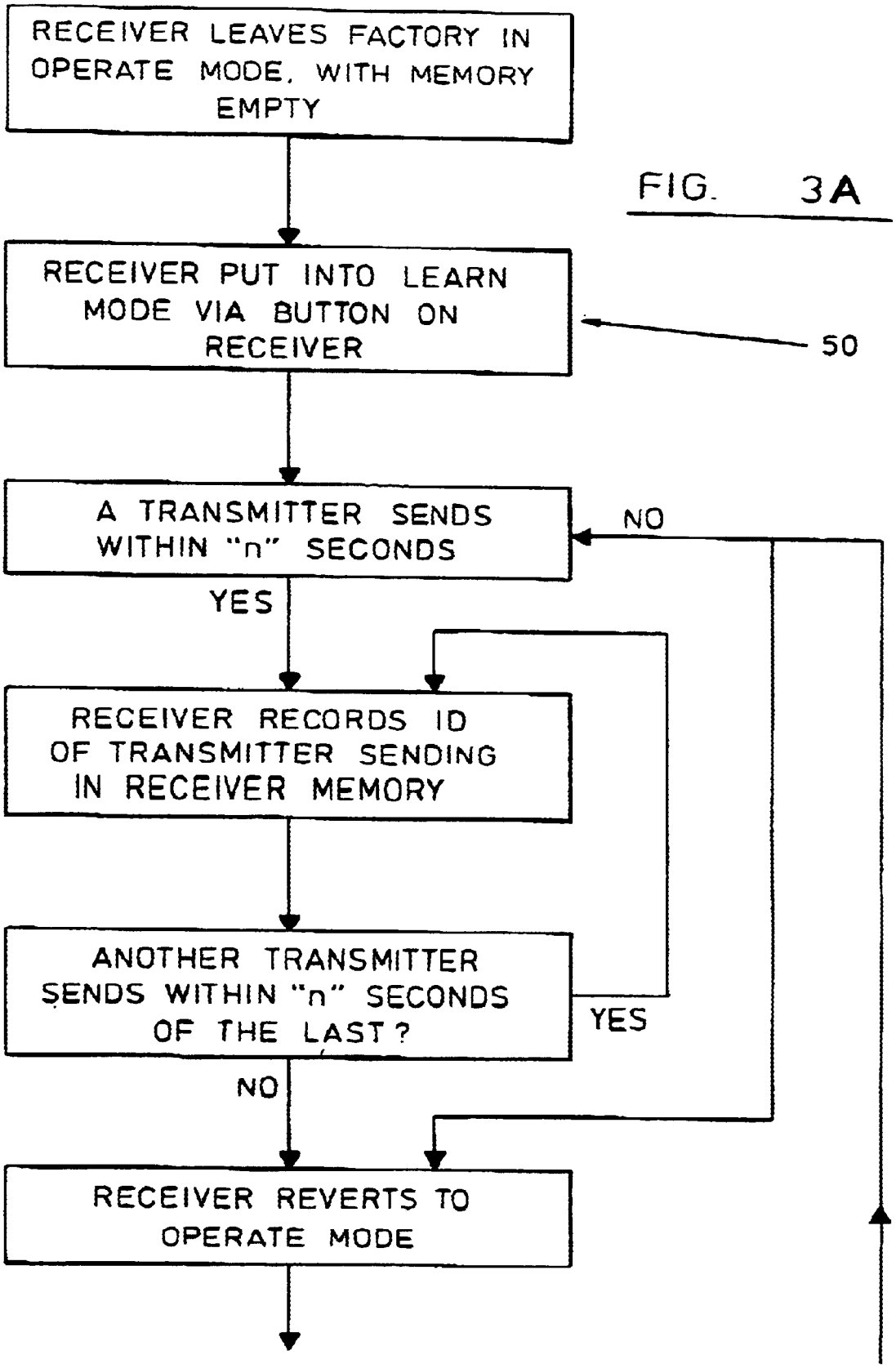
FIG. 3 is a flow diagram to explain the programming operation of the apparatus of FIG. 1.
Figure 3B:
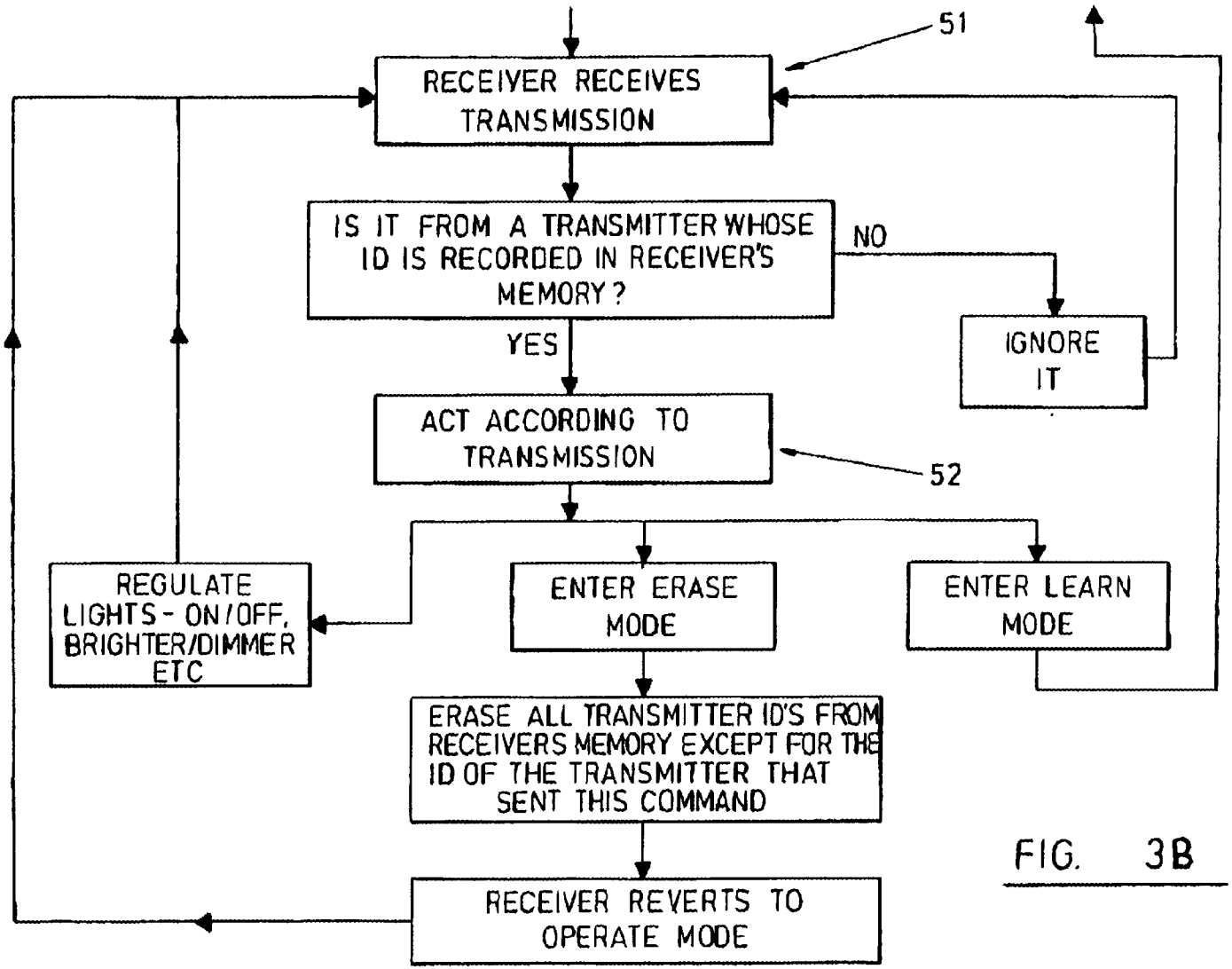

Referring to FIG. 3 of the drawings, the control unit will preferably only respond to specified transmitters and the transmitters are arranged to transmit a unique address code within their control signal, so that they can be differentiated. In use, before the control unit is installed, its memory thus has to be programmed with the identities of the transmitters which it is to respond to. This is achieved, at step 50, by actuating a switch on the control unit to set it in a LEARN mode. In the LEARN mode, the control unit will store the unique address code of any transmitters that are actuated to transmit their control signal within a predetermined time period n. The control unit then reverts automatically into its OPERATE mode.

When the receiver of the control unit receives a control signal, at step 51, this is decoded to check whether the address code corresponds with an address code programmed into the control unit's memory. At step 52, the control unit will then only act on control signals that are received from a transmitter whose address code corresponds with an address code programmed into its memory.

Once the control unit has been installed in a ceiling void, it is no longer possible to gain access to the control unit to put it back into the LEARN mode, say when further transmitters are to be added to the system. Thus, each transmitter may be arranged to transmit a control signal to remotely put the control unit into the LEARN mode.

When removing transmitters from the system, it is often desirable to initially clear all address codes from the control unit's memory before the same or new address codes are programmed into the control unit's memory. However, this would mean that the control unit would no longer be able to respond to control signals to put it into the LEARN mode and thus the control unit would be rendered useless.

In order to overcome this problem, each transmitter may be arranged to transmit a control signal to remotely put the control unit into an ERASE mode. In the ERASE mode, the control unit erases all address codes from its memory, with the exception of the address code of the transmitter which gave the command to the control unit to enter the ERASE mode.

The transmitter which gave the command to the control unit to enter the ERASE mode can then be used to set the control unit in the LEARN mode, whereupon the same or new address codes can be programmed into the control unit's memory, as hereinbefore described.

Figure 4:
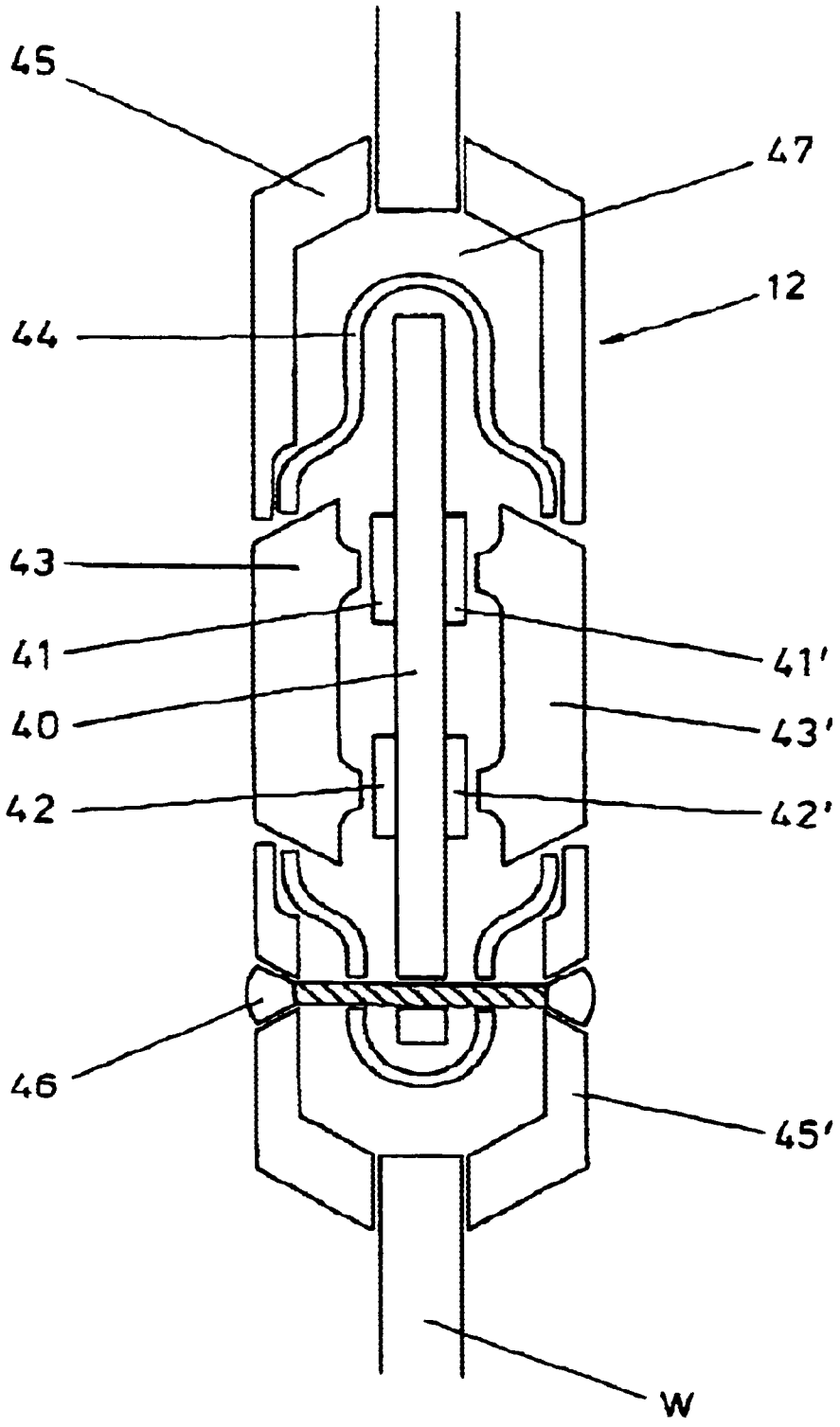
FIG. 4 is a sectional view through a remote control device of the assembly of FIG. 1.

Referring to FIG. 4 of the drawings, in one embodiment, the remote device 12 forms a wall switch which can be actuated from either side of a wall W. The device 12 comprises a double-sided printed circuit board 40 having a pair of ON switches 41,41' and a pair of OFF switches 42, 42' arranged on its respective opposite sides. The switches of the same type are electrically connected in parallel with each other.

A battery-powered radio transmitter is also mounted on the printed circuit board 40. The transmitter is arranged to transmit remote control ON and OFF signals, when the respective switch 41, 41', 42, 42' is actuated.

The printed circuit board 44 is enclosed inside a plastics housing 44. A pair of rocking actuators 42, 42' are pivotally mounted to the housing 44 on respective opposite sides of the printed circuit board 40, such that the ON switches 41, 41' are respectively actuated when the top of the respective actuator 43, 43' is depressed and such that the OFF switches 42, 42' are respectively actuated when the bottom of the respective actuator 43, 43' is depressed.

In use, the remote device 12 is mounted in an aperture 47 in the wall W, where it is retained by apertured face plates 45, 45' that are fitted to respective opposite sides of the wall W. The face plates 45, 45' are connected to each other by means of screws 46.

It will be appreciated that the remote control device 12 of FIG. 3 resembles a conventional wall switch, when viewed from either side of the wall W. However, the device provides the advantage that the light can be controlled from either side of the wall, without the need to run wires to the light 11.

What is claimed is:

1. An electrical switching system for controlling an electrical load, comprising:

a remote control device capable of being actuated for transmitting a wireless control signal;

a control unit having an input for connecting to a current source, an output for connecting to said electrical load, a receiver for receiving said wireless control signal, and a switching device connected in series between said input and said output; and, a remote switch connected in series between a signal source and a switch terminal of said control unit via a conductor, said remote switch being switchable between a first position, wherein said wireless control signal from said signal source is applied to said switch terminal, and a second position, wherein said wireless control signal from said signal source is not applied to said switch terminal, said control unit further comprising means for monitoring said receiver and said switch terminal and means for controlling said switching device for changing a state of electrical connection between said output and said input when either said wireless control signal is received by said receiver or when said wireless control signal on said switch terminal changes for indicating a change of switch position from said first position to said second position, or from said second position to said first position.

2. The electrical switching system for controlling an electrical load according to claim 1, wherein said remote control device comprises a hand-held device.

3. The electrical switching system for controlling an electrical load according to claim 1, wherein said remote control device includes means for mounting said remote control device to a wall.

4. The electrical switching system for controlling an electrical load according to claim 3, wherein said remote control device resembles a wall switch.

5. A control system, comprising:

a control unit configured for responding to a plurality of remote control devices, each remote control device of said plurality of remote control devices having an address code able to be transmitted to said control unit together with control signals, said control unit further comprising:

memory means for storing the address code of each said remote control device to which said control unit is configured to respond; and, means for responding to an erase control signal received from one said remote control device of said plurality of remote control devices for erasing from said memory means said address code of each said control device of all remaining control devices of said plurality of remote control devices.

6. The control system according to claim 5, wherein at least one said remote control device of said plurality of remote control devices comprises a switch assembly having switching means connected to a transmitting device, said transmitting device transmitting wireless remote control signals upon actuation of said switching means.

* * * * *